US006799839B2

(12) United States Patent
Hayakawa et al.

(10) Patent No.: US 6,799,839 B2
(45) Date of Patent: Oct. 5, 2004

(54) STRUCTURE PROVIDED WITH THROUGH HOLE, METHOD OF MANUFACTURE THEREFOR, AND LIQUID DISCHARGE HEAD

(75) Inventors: Yukihiro Hayakawa, Kanagawa (JP); Genzo Momma, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/273,336

(22) Filed: Oct. 18, 2002

(65) Prior Publication Data

US 2003/0081068 A1 May 1, 2003

(30) Foreign Application Priority Data

Oct. 30, 2001 (JP) ..... 2001-332549

(51) Int. Cl.[7] ..... B41J 2/05
(52) U.S. Cl. ..... 347/64; 347/63
(58) Field of Search ..... 347/63, 64

(56) References Cited

U.S. PATENT DOCUMENTS 6,143,190 A 11/2000 Yagi et al. ..... 216/27
6,450,621 B1 9/2002 Hayakawa ..... 347/63
6,467,884 B1 10/2002 Murooka et al. ..... 347/64

FOREIGN PATENT DOCUMENTS

JP 10-181032 7/1998

OTHER PUBLICATIONS

Sazonov, A, "Materials Optimization for Thin Film Transistors Fabricated at Low Temperatures on Plastic Substrates," Journal of Non–Crystalline Solids, May 2000, vol. 266–269, pp. 1329–1334 (abstract), Derwent [online].*

* cited by examiner

*Primary Examiner*—Michael S. Brooke
(74) *Attorney, Agent, or Firm*—Fitzpatrick, Cella, Harper & Scinto

(57) ABSTRACT

A structure having a base plate, such as silicon, provided with a through hole makes it possible to curtail the process numbers at the time of manufacture, while enhancing the reliability thereof. When the through hole is provided by anisotropic etching from the backside of the base plate, a silicon nitride film, which becomes membrane on the surface side of the base plate is formed so as not to allow etching solution from leaking to the surface side of the base plate. It is preferable to form the silicon nitride film using plasma CVD method to make the inner stress of the silicon nitride film a compression stress of $3\times10^8$ Pa or less.

6 Claims, 11 Drawing Sheets

PRIOR ART

STRUCTURE PROVIDED WITH THROUGH HOLE, METHOD OF MANUFACTURE THEREFOR, AND LIQUID DISCHARGE HEAD

BACKGROUND OF THE INVENTION

1. Field of the Invention

The present invention relates to a structure provided with a through hole, which is formed by silicon (Si) semiconductor base plate and others, and also, relates to a method for manufacturing such structure. More particularly, the invention relates to the structure, which is preferably used for a thermal recording head, an ink jet recording head, or the like used for a printer or other printing apparatus, and also, the invention relates to the liquid discharge head and apparatus using such structure.

2. Related Background Art

A structure provided with a through hole is used in various fields. For example, the ink jet recording head used for an ink jet printer or the like that performs recording by discharging ink, uses a structure formed by silicon semiconductor base plate and others provided with a through hole. Hereinafter, by way of example, the description will be made of the structure having a through hole for an ink jet recording head that discharges ink by the application of thermal energy.

For the ink jet recording head that utilizes thermal energy, liquid is given thermal energy generated by heat generative resistive member (heater), thus selectively creating bubbling phenomenon in liquid so as to discharge ink liquid droplet from the discharge port by means of energy exerted by such bubbling. The ink jet recording head of the kind has many numbers of fine heat generating resistive members arranged on a silicon semiconductor base plate or the like in order to enhance recoding density (resolution), and further, each of the discharge ports is arranged to face each of the heat generating resistive members per heat generating resistive member. Then, the driving circuit and peripheral circuits are also arranged on the silicon semiconductor base plate to the heat generating resistive members, respectively.

FIG. 8 is a cross-sectional view that shows the structure of the ink jet recording head of the kind.

As shown in FIG. 8, on one main surface of the silicon base plate 100 of an ink jet recording head, there are laminated a field oxide film (LOCOS oxide film) 101, the BPSG (boro-phospho-silicate-glass) layer 102, which is formed by the non-pressure CVD (chemical vapor development) method, and the silicon oxide film 103, which is formed by the plasma CVD method. Thus, the heat generating resistive member (heater) 110 is formed on the silicon oxide film 103. Further, the discharge port 140 is arranged to face the heat generating resistive member 110. In FIG. 8, only one heat generating resistive member 110 and only one discharge port 140 are represented. Actually, however, several hundreds of heat generating resistive members and discharge ports are provided for an ink jet recording head. These heat generating resistive members are arranged on one single silicon base plate 100 at designated intervals (40 $\mu$m, for instance) in the direction perpendicular to the surface of FIG. 8.

Further, in order to protect the heat generating resistive member 110 and others, the silicon nitride film 104, which is formed as a passivation layer by the plasma CVD, is provided for the entire surface of the aforesaid main surface of the silicon base plate 100, including above the heat generating resistive member 110. On the portion of the surface of the silicon nitride film 104, which corresponds to the heat generating resistive member 110, tantalum (Ta) film 105 is formed as a cavitation proof layer in order to prevent the silicon nitride film 110 from being deteriorated by the cavitation phenomenon due to bubbles generated in ink. In this respect, the surface of the main surface of the silicon base plate 100 on the side having no heat generating resistive member 110 formed is covered by thermal oxidation film 106.

The discharge port 140 is formed on the resin covering layer 130 that covers the aforesaid main surface of the silicon base plate 100. There is a space formed between the resin covering layer 130 and silicon nitride film 104, and the tantalum film 105 as well. In this space the liquid (ink) that should be discharged from the discharge port 140 is filled. This space is called a liquid chamber 150.

The ink jet head thus structured is arranged to generate heat when the heat generating resistive member 110 is energized, and create bubbles by such heat in discharge liquid in the liquid chamber 150, hence discharging liquid droplets from the discharge port 140 by the acting force of such bubbles thus created. In order to perform recording continuously, discharge liquid (ink) must be supplied to the liquid chamber 150 in an amount corresponding to the amount of liquid that has been discharged from the discharge port 140. However, the discharge port 140 is arranged near a recording medium, such as paper, and also, the gap between the discharge port 140 and the heat generating resistive member 110 is set minutely. Therefore, it is made difficult to supply discharge liquid into the liquid chamber 150 from the side where the heat generating resistive member 110 is formed for the silicon base plate 100. Here, as shown in FIG. 8, a supply port 120 that penetrates the silicon base plate 100 is provided to enable discharge liquid to flow in the direction indicated by an arrow in FIG. 8 through the discharge port 120 for supplying it into the liquid chamber 150. The supply port 120 is formed with etching the silicon base plate 100.

Now, the thickness of the silicon base plate 100 is several hundreds of $\mu$m in general, and if it is intended to etch the silicon base plate 100 for the formation of the supply port 120 from the main surface where the heat generating resistive member 110 is formed, each layer and the heat generating resistive member 110 formed on this main surface are damaged unavoidably, because it takes a long time to complete such etching even under condition established to selectively etch only the silicon base plate 100. Therefore, for the formation of the supply port 120, the silicon base plate 100 is etched from the main surface where no heat generating resistive member 110 is formed. In this case, too, if etching solution should flow into the side where the heat generating resistive member 110 is formed when the penetration of the supply port 120 is completed, there is a fear that damage is given to the heat generating resistive member 110, as well as to each of the other layers. Now, therefore, on the main surface of the silicon base plate 100 on the side where the heat generating resistive member 110 is formed, the layer that becomes an etching stopper is formed in advance on the position where the formation of the supply port 120 is expected. In this manner, it is arranged to prevent etching solution from flowing into the side where the heat generating resistive member 110 is formed.

For the area where the supply port 120 is formed for the one shown in FIG. 8, the filed oxide film 101, the BPSG layer 102, and the silicon oxide film 103 are not provided, but in place thereof, the silicon nitride film 107, which is formed by the reduced pressure CPD method, is provided. The silicon nitride film 107 is patterned and provided so that it is arranged only for the formation area of the supply port 120 and around it. The edge portions thereof are sandwiched between the field oxide film 101 and the silicon oxide film 102. In the formation area of the supply port 120, the silicon nitride film 107 is directly deposited on a thin oxide film 108 of the surface of the silicon base plate 100. The silicon nitride film 104, which is formed by the plasma CVD method, is also formed on the silicon nitride film 107, which is formed by the reduced pressure CVD method.

As described later, in the last stage of etching, the silicon nitride film 107 is exposed to the bottom face of the supply port 120 thus formed. Here, if the silicon nitride film 107 and silicon nitride film 104 are broken or peeled off from the silicon base plate 100 in this stage, etching solution is allowed to leak to the heat generating resistive member 110 side. This is not desirable. Therefore, the silicon nitride film 107 is formed by the reduced pressure CVD method to make the inner stress of the silicon nitride film 107 a tensile stress whereby to prevent the occurrence of peeling as disclosed in the specification of Japanese Patent Application Laid-Open No. 10-181032 (as well as in the specification of the corresponding U.S. Pat. No. 6,143,190).

Here, the structure of the heat generating resistive member 110 will be described. FIG. 9A is a perspective view that schematically illustrates the structure of the heat generating resistive member (heater). FIG. 9B is a circuit diagram that shows the portion that contains the heat generating resistive member and the switching element that drives it.

It is arranged to form the heat generating resistive member 110 by patterning the resistive layer 111 formed by material having electric resistance, such as tantalum silicon nitride (TaSiN), and the aluminum (Al) layer 112 that becomes electrodes in the same shape, and then, part of the aluminum layer 112 is removed so that only resistive layer 111 remains to be present in such portion. This portion where only the resistive layer 111 exists becomes the portion that generates heat when electricity is charged thereon, and becomes the heat generating resistive member 100. In FIG. 9A, after the resistive layer 111 and the aluminum layer 112 are formed on the silicon oxide film 103 in that order, the unwanted parts of both layers are removed so that it shows a U-shaped at first. Then, only the aluminum layer 112 is removed on the portion that becomes the heat-generating portion. In this way, the heat generating resistive member 110 is completed. After that, the silicon nitride film 104 that serves as the passivation layer covers the entire body thereof.

Next, the description will be made of a method for manufacturing an ink jet recording head of the kind. Hereinafter, in order to simplify the description, it is assumed not to consider the thermal oxidation film 106 that should be formed on the side of the silicon base plate 100 where the heat generating resistive member 110 is not formed. Also, in FIGS. 10A, 10B, 10C, and 10D, and FIGS. 11A, 11B, and 11C only the structure of the supply port 120 (the position where it is formed) and circumferential portion thereof is represented.

A method for manufacturing an ink jet recording head using a silicon base plate provided with a through hole is disclosed in the specification of Japanese Patent Application Laid-Open No. 10-181032, for example.

At first, as shown in FIG. 10A, a field oxide film 101 of approximately 700 nm, for instance, is selectively formed on one main surface of a silicon base plate 100. On the portion where no field oxide film 101 is formed, a thin oxide film 108 is formed. Then, as shown in FIG. 10B, the oxide film 108 is removed corresponding to the position where the supply port 120 is formed, so that the silicon surface is exposed accordingly. Further, as shown in FIG. 10C, the poly-silicon layer 121 that serves as the sacrificing layer is formed selectively in a thickness of 200 to 500 nm on the position where the silicon surface is exposed. At this time, the silicon surface having no oxide film 108 formed is arranged to surround the poly-silicon layer 121 completely. After that, as shown in FIG. 10D, the silicon nitride film 107, which is provided by the reduced pressure CVD method, is formed on the position where the supply port 120 is formed and circumferential portion thereof. The thickness of the silicon nitride film 107 is approximately 200 to 300 nm, for example.

After that, as shown in FIG. 11A, the BPSG layer 102, which is provided by the non-pressure CVD method, is formed entirely on the silicon nitride film 107 and the field oxide film 101 in a thickness of 700 nm, for example. Further, entirely thereon, the silicon oxide film 103, which is provided by the plasma CVD method, is formed in a thickness of 1.4 $\mu$m. The surface of the silicon oxide film 103 is almost flat. Then, as shown in FIG. 11B, corresponding to the position where the supply port 120 is formed, the silicon oxide film 103 and the BPSG layer 102 are selectively removed in an area slightly larger than the supply port 120. Here, the arrangement should be made so that the edge portions of the part to be removed are positioned above the silicon nitride film 107, but the field oxide film 101 exists below it.

In continuation, the resistive layer 111 and the aluminum layer 112 are formed. Then, as described above, these are patterned in the U-letter form, and with the aluminum layer 112 positioned to be the heat generating portion being selectively removed, the heat generating resistive member 110 is formed on the silicon oxide film 103. Subsequently, as shown in FIG. 11C, the silicon nitride film 104, which becomes a passivation layer, is formed on the entire surface in a thickness of 300 to 800 nm, for example. Then, after the tantalum film 105 that serves as a cavitation proof layer is selectively formed, the silicon base plate 100 on the position where the supply port is formed, and the poly-silicon layer 121 that serves as a sacrificing layer are removed by anisotropic etching from the side of the silicon base plate (from the lower side in FIG. 11C) where no heat generating resistive member 110 of the silicon base plate 100 is provided, thus forming the supply port 120. At this juncture, on the bottom face of the supply port 120, the silicon nitride film 107, which is backed with the silicon nitride film 104, is exposed as the so-called membrane. At the last stage of etching, etching solution is prevented only by this membrane from entering the heat generating resistive member 110 side. Therefore, it should be arranged so that the membrane is not broken or peeled off, because this greatly contributes to enhancing the production yield of recording head.

Lastly, by means of dry etching using fluorine gas or oxygen gas, the silicon nitride film 107 positioned on the bottom face of the supply port 120 and the silicon nitride film 104 are removed. In this way, the base plate used for a recording head, which is provided with the supply port 120 as a through hole for supplying ink or the like, is completed. Thereafter, it should be good enough if only the resin covering layer 130 and discharge port 140 are formed by the known method.

Of the processes described above, the patterning processes (only those which need photomask) for the formation of the supply port 120 are the process in which the oxide film 108 is partly removed as shown in FIG. 10B; the process in which the poly-silicon layer 121 is selectively provided as shown in FIG. 10C; the process in which the silicon nitride film 107 is selectively provided as shown in FIG. 10D; the process in which the BPSG layer 102 and silicon oxide film 103 are removed by etching corresponding to the position of the supply port 120 as shown in FIG. 11B; and the process in which the silicon base plate 100 is etched to from the supply port 120 as shown in FIG. 11C.

On the other hand, as shown in FIG. 9B, one end of the heat generating resistive member 110 is connected with the power-supply source VH of approximately +30 V, and the other end thereof is connected with the drain of a MOS field effect transistor M1 that serves as a drive switching element. Then, the source of the transistor M1 is grounded. The gate thereof is driven when driving pulse is applied. Here, when the driving circuit that includes this transistor M1, and other peripheral circuits is incorporated on the silicon base plate 100, the BPSG layer 102 and the silicon oxide film 103 are formed so as to be an interlayer insulation film, and the silicon nitride film 104 to be a passivation layer. Then, the field oxide film 101 is used for element separation in the formation area of the driving circuit and peripheral circuits thereof.

For the conventional structure, the silicon nitride film 107, which is formed by the reduced pressure CVD method, is intentionally used as a membrane serving as an etching stopper when the supply port 120 is formed. This is because the inner stress of this membrane is tensile stress. In contrast, the inner stress of silicon nitride film 103, which is formed by the plasma CVD method, is compression stress. Conventionally, it has been thought that in order not to allow membrane to be broken or peeled off at the time of etching, a film having tensile stress as a membrane is used so that tension is kept as the membrane, while arranging such film having tensile stress on the silicon base plate side, thus enhancing the bonding power thereof. With this thought, the silicon nitride film 107, which is formed by the reduced pressure CVD method, is used. In other words, it is thought that such problem of breakage and peeling off cannot be solved by use of a film having compression stress.

In the case of the conventional method for manufacturing an ink jet recording head as described above, five photomasks are needed only for the process in which the supply port is formed even when it is arranged to perform a simultaneous procession of the process in which the silicon base plate is penetrated for the formation of the supply port, and the process in which the heat generating resistive member, the driving circuit and peripheral circuits are formed on the silicon bas plate. In this case, if the other parts (not shown) are also processed, it becomes necessary to use 17 to 18 photo-masks altogether, which makes the processes more complicated. Particularly, the silicon nitride film (the silicon nitride film formed by the reduced pressure CVD method in the aforesaid example) having tensile stress as a membrane is patterned for the provision thereof. As a result, a problem is encountered that numbers of processes are too many.

On the other hand, it has been thought that if the silicon nitride film, which is formed by the plasma CVD method, is used as a membrane, without the formation of silicon nitride film having tensile stress, such problem of breakage or peeling off occurs unavoidably.

Now, therefore, it is an object of the present invention to provide an inexpensive, but highly reliable structure and the method of manufacture therefor by reducing the number of processes.

It is another object of the invention to provide a structure and the method of manufacture therefor, making it possible to enhance more the durability of silicon nitride film constituting a membrane that functions as an etching stopper when a through hole is formed.

It is still another object of the invention to provide a liquid discharge head and a liquid discharge apparatus using such structure.

The present invention is designed with a view to solving the problems discussed above in order to achieve at least one of the objects referred to in the preceding paragraphs.

SUMMARY OF THE INVENTION

Now, as a result of assiduous studies made by the inventors hereof, it has been found that even the silicon nitride film, the inner stress of which becomes a compression stress by use of plasma CVD method, can be adopted as membrane when a through hole is formed if only the value of the inner stress (compression stress) thereof is the designated $3\times10^8$ Pa ($3\times10^9$ dyn/cm$^2$) or less. With this finding, the present invention is completed.

In other words, the structure of the present invention comprises a semiconductor base plate, and a silicon oxide film and a silicon nitride film formed on a first main surface of the semiconductor base plate, being provided with a through hole penetrating the semiconductor base plate and the silicon nitride film, in which the silicon oxide film is patterned to be arranged on the first main surface of said semiconductor base plate with the exception of the circumferential portion of the through hole, and the silicon nitride film is arranged to be in contact with the semiconductor base plate on the circumferential portion of the through hole on the first main surface of said semiconductor base plate, while covering the silicon oxide film, and the inner stress of the silicon nitride film is a compression stress of $3\times10^8$ Pa or less.

The method of the present invention for manufacturing a structure having a semiconductor base plate, and a silicon oxide film and a silicon nitride film formed on a first main surface of the semiconductor base plate, which is provided with a through hole penetrating the semiconductor base plate and the silicon nitride film, comprises the steps of forming a sacrificing layer on the first main surface of the semiconductor base plate corresponding to the position of the through hole formation; forming a silicon oxide film to cover the entire surface of the sacrificing layer and the first main surface;

patterning the silicon oxide film to enable the first main surface to be exposed on the circumference of the sacrificing layer; forming a silicon nitride film to cover the silicon oxide film and the sacrificing layer with the inner stress thereof being a compression stress of $3\times10^8$ Pa or less; and etching the semiconductor base plate from a second main surface side of the semiconductor base plate to remove the sacrificing layer, and forming a through hole by etching the silicon nitride film.

Now, the inner stress of silicon nitride film is discussed with respect to the present invention. For the invention, it is good enough if the inner stress of silicon nitride film is the compression stress the value of which is $3\times10^8$ Pa or less. It is particularly preferable to make it $5\times10^7$ Pa or more and $2\times10^8$ Pa or less. There is no particular lower limit set for the inner stress, but if the inner stress is made extremely small, there is a fear that the strength of the silicon nitride film becomes lower. Therefore, it is preferable to make it $5\times10^7$ Pa or more practically. It is possible to form a silicon nitride film of the kind by use of plasma CVD method in good condition.

For the present invention, it is preferable that the semiconductor base plate is silicon base plate, and preferably, circuit elements are formed on a first main surface of this silicon base plate. Here, the circuit elements are MOS field effect transistor and others, for example, which are formed by the usual semiconductor manufacturing process on the first main surface. When the circuit elements are formed, it is preferable to execute the process in which the silicon oxide film is patterned simultaneously in the process of froming a contact hole and the process of forming a through hole in the process in which the circuit elements are formed. Further, preferably, the sacrificing layer is formed simultaneously in the process in which the gate electrodes or source·drain electrodes with the same material used for the gate electrodes or source·drain electrodes.

The structure described above is preferably used as a base plate for a liquid discharge head. The base plate of the kind for use of a recording head comprises a semiconductor base plate, a silicon oxide film and a silicon nitride film formed on a first main surface of the semiconductor base plate, and a heat generating resistive member put between the silicon oxide film and the silicon nitride film, being provided with a supply port for supplying liquid penetrating the semiconductor base plate and the silicon nitride film in which the silicon oxide film is pattered to be arranged for the first main surface of said semiconductor base plate with the exception of the circumferential portion of the supply port, and the silicon nitride film is arranged to be in contact with the semiconductor base plate on the circumferential portion of the supply port on the first main surface of said semiconductor base plate, while covering the silicon oxide film, and the inner stress of the silicon nitride film is a compression stress of $3\times10^8$ Pa or less. In this case, the semiconductor base plate is silicon base plate, and it is preferable to form circuit elements on the first surface for driving the heat generating resistive member.

Then, the liquid discharge apparatus of the present invention is provided with the liquid discharge head described above, and a container for containing liquid to be supplied through the aforesaid supply port.

DETAILED DESCRIPTION OF THE PREFERRED EMBODIMENTS

Next, with reference to the accompanying drawings, the preferred embodiments will be described in accordance with the present invention.

Figure 1:
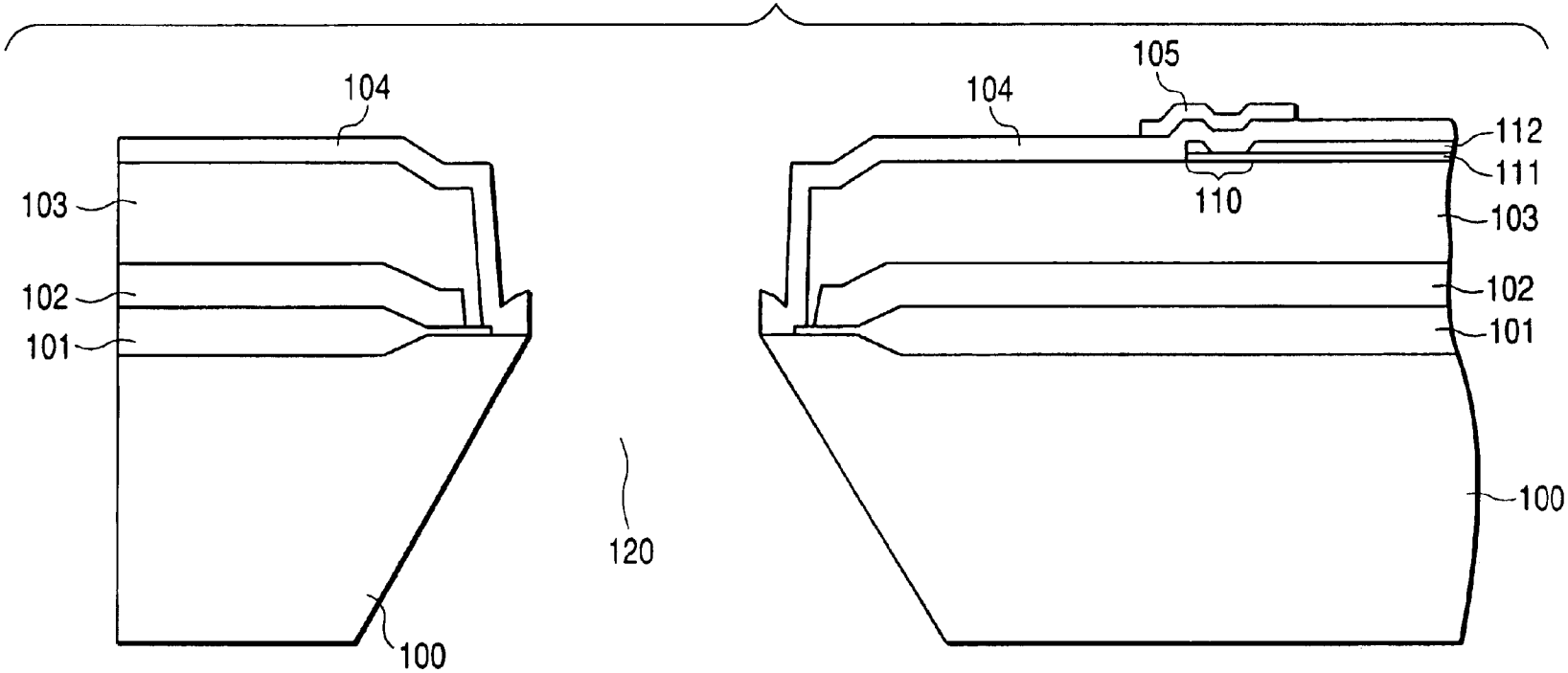
FIG. 1 is a cross-sectional view that schematically shows a structure used as a base plate for an ink jet recording head, which is the structure in accordance with one embodiment of the present invention.

FIG. 1 is a cross-sectional view that schematically shows a structure in accordance with one embodiment of the present invention. In FIG. 1, those members given the same reference numerals as those appearing in FIG. 8, FIGS. 10A, 10B, 10C and 10D, and FIGS. 11A, 11B, and 11C have the same functions of the members given the same reference numerals in FIG. 8, FIGS. 10A, 10B, 10C and 10D, and FIGS. 11A, 11B, and 11C.

The structure shown in FIG. 1 is formed as the base plate for use of an ink jet recording head serving as a liquid discharge head and a liquid discharge apparatus. Here, for the structure shown in FIG. 8, FIGS. 10A, 10B, 10C and 10D, and FIGS. 11A, 11B, and 11C, the silicon nitride film, which is formed by the reduced pressure CVD method and used conventionally, is not provided, but the silicon nitride film 104, which functions as a passivation layer, is used, and the difference lies in that the range of compression stress is regulated. The silicon nitride film 104 is directly in contact with the silicon base plate 100 on each edge portion of the supply port 120 without intervention of the oxide film. The film formation thereof is conditioned so that the inner stress becomes a compression stress of $3\times10^8$ Pa or less. Also, the difference lies in that the size of the portion removed for the supply port 120 is substantially equal to the area of the BPSG layer 102 and the silicon oxide film 103 removed for supply port 120. (As discussed above with reference to FIG. 11B, in the conventional art the BPSG layer 102 and the silicon oxide film 103 are selectively removed in an area slightly larger than the supply port 120.) Then, although not shown here, the driving circuit for driving each heat generating resistive member and peripheral circuits are integrated on the silicon base plate 100 monolithically. Now, hereunder, in accordance with examples, the description will be made of the structure having such driving circuit and peripheral circuits integrated therefor.

For the method of manufacture of this structure, the description will be made in conjunction with FIGS. 2A, 2B, and 2C, and FIGS. 3A, 3B, and 3C. FIGS. 2A, 2B, and 2C, and FIGS. 3A, 3B, and 3C represent only around the position where the supply port 120 is formed, but it is not intended to represent the ones that contain the formation area of the heat generating resistive member.

Figure 2A:
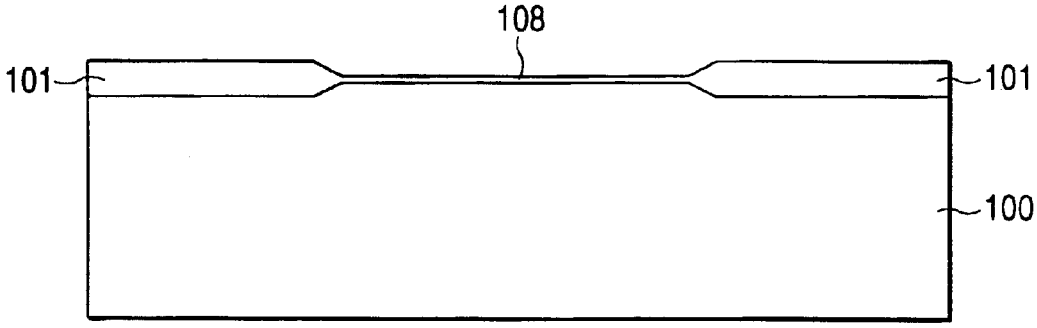
FIGS. 2A, 2B, and 2C are cross-sectional views that schematically illustrate the manufacturing process of the structure shown in FIG. 1.
Figure 2B:
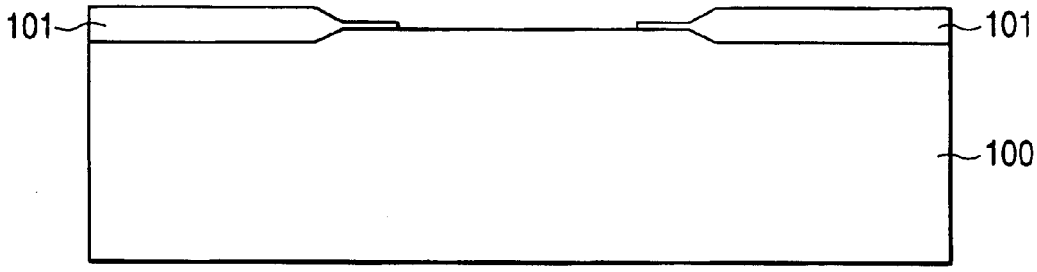
Figure 2C:
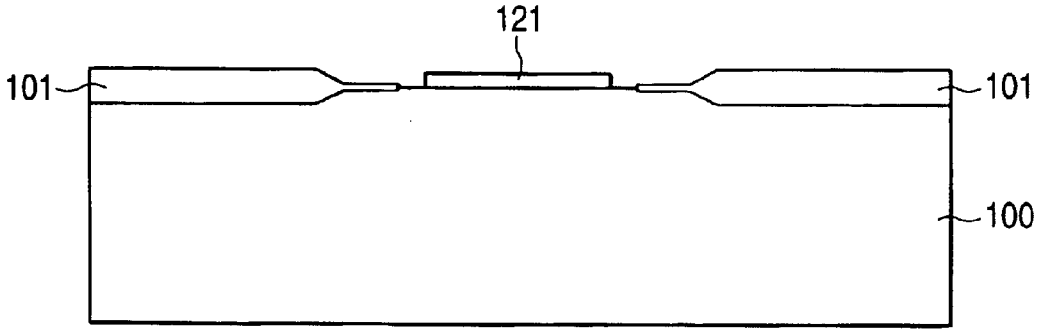

At first, as shown in FIG. 2A, a field oxide film 101 is formed selectively by thermal oxidation in a thickness of approximately 700 nm, for example, on one main surface of a silicon base plate 100. On the portion where no filed oxide film 101 is formed, a thin oxide film 108 is formed. Then, as shown in FIG. 2B, the oxide film 108 is removed corresponding to the position where the supply port 120 is formed, thus enabling the silicon surface to be exposed, and further, as shown in FIG. 2C, a poly-silicon layer 121 that becomes sacrificing layer is selectively formed by the reduced pressure CVD and reactive ion etching, for example, in a thickness of 200 to 500 nm, for example, on the exposed position of the silicon surface. At this time, it is arranged so that the poly-silicon layer 121 is surrounded completely by the silicon surface having no oxide film 108 formed therefor. In this respect, by the time the stage shown in FIG. 2C is completed, the formation process of the gate insulation film and gate electrodes has been over in the formation area of the driving circuit and peripheral circuits. Here, if the polysilicon layer 121 should be formed in the same process of filming and etching the gate electrodes of the MOS transistor that constitutes the driving circuit and peripheral circuits, there is no need for the provision of a mask dedicated for use of the sacrificing layer.

After that, it is arranged to complete the process of impurity implantation in the source/drain regions, and the like.

Figure 3A:
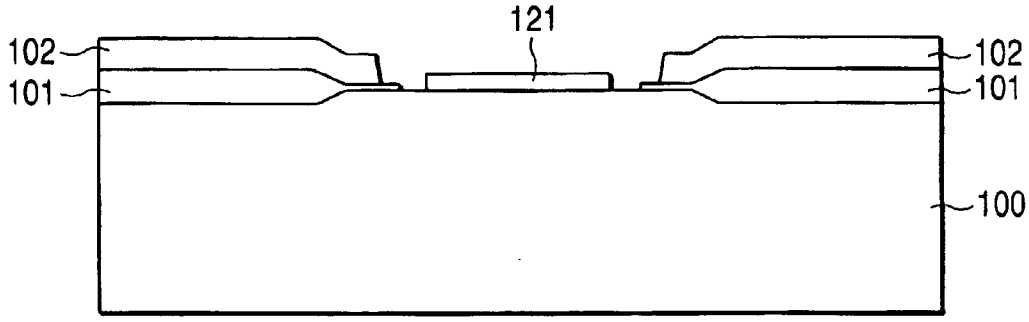
FIGS. 3A, 3B, and 3C are cross-sectional views that schematically illustrate the manufacturing process of the structure shown in FIG. 1.
Figure 3B:
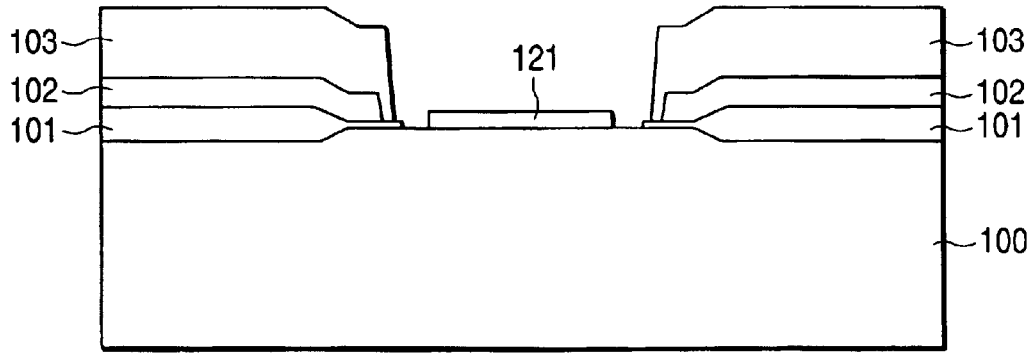

Next, the BPSG layer 102 is formed in a thickness of 700 nm by the non-pressure CVD method, for example, on the entire surface, and then, in the process of forming a contact holes for the driving circuit and peripheral circuits, the BPSG layer 102 is removed simultaneously by reactive ion etching corresponding to the position where the supply port 120 is formed as shown in FIG. 3A. At this juncture, it is arranged to enable the poly-silicon layer 121 and the silicon surface surrounding the poly-silicon layer 121 (the position where no oxide film 108 is formed) to be exposed. In other words, in the same process in which contact holes are opened on the BPSG layer 102 for the driving circuit and peripheral circuits, the BPSG layer is removed corresponding to the position of the supply port. Therefore, there is no need for the provision of any mask dedicated for sue of the supply port portion. Then, after that, conductor, such as aluminum, is deposited for the driving circuit and peripheral circuits, thus forming the source electrode/drain electrode by dry etching using chlorine gas. Subsequently, with the plasma CVD method, the silicon oxide film 103 is formed on the entire surface in a thickness of 1.4 $\mu$m, for example. The surface of the silicon oxide film 103 is almost flat. Next, in the process of forming through hole for use of interlayer wiring for the driving circuit and peripheral circuits as shown in FIG. 3B, the silicon oxide film 103 is removed simultaneously by use of reactive ion etching corresponding to the position where the supply port 120 is formed. Here, there is no need, either, for the provision of any mask dedicated for use of the supply port portion. At this juncture, it is arranged so that the poly-silicon layer 121 and the silicon surface surrounding the poly-silicon layer 121 (the position where no oxide film 108 is formed) are exposed.

Figure 3C:
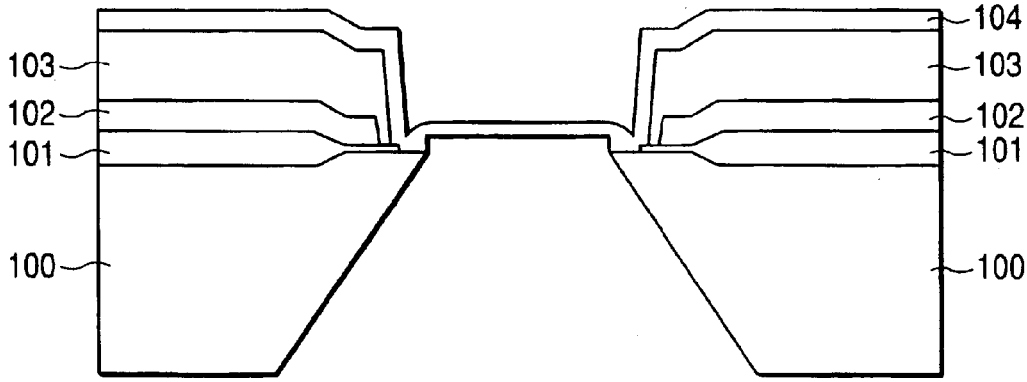

After that, although not shown here, the heat generating resistive member is formed in the same manner as in the case of the conventional art, and by way of through hole, connection with driving circuit is made. Then, the silicon nitride film 104, which serves as the passivation layer, is formed on the entire surface in a thickness of 300 to 800 nm, for example, and after the tantalum film (not shown), which becomes the cavitation proof layer, is formed selectively, an anti-etching mask (not shown) if formed on the backside of the base plate as shown in FIG. 3C, and then, from the lower side of the silicon base plate 100 in FIG. 3C, the silicon base plate 100 on the position where the supply port is formed and the poly-silicon layer 121, which is a sacrificing layer, are removed by anisotropic etching using etching solution such as TMAH (tetramethyl ammonium hydroxide), thus forming the supply port 120. Here, the film formation is conditioned so as to produce the silicon nitride film 104 with the inner stress thereof being compression stress of $3\times10^8$ Pa or less. At this juncture, the silicon nitride film 104 is exposed as membrane on the bottom portion of the supply port 120.

Lastly, from the backside of the base plate, the silicon nitride film 104 positioned on the bottom face of the supply port 120 is removed by dry etching using fluorine gas or oxygen gas. In this way, the base plate for use of a recording head, which is provided with the supply port 120 for supplying ink or the like as a through hole, is completed. Thereafter, with the known method, the resin covering layer 130 and the discharge port 140 are formed to complete an ink jet recording head provided with the aforesaid structure as the base plate for use of a recording head.

Here, the description will be made of the silicon nitride film 104 formed by the plasma CVD method, which serves as the passivation layer, and also, functions as membrane when the supply port 120 is formed by etching. In general, the inner stress of the silicon nitride film formed by the plasma CVD method is a compression stress. Conventionally, it has not been considered suitable for use of membrane. By the studies made by the inventors hereof, however, it has been found that even the silicon nitride film formed by the plasma CVD method can be used preferably as membrane if only the compression stress thereof is $3\times10^8$ Pa. A silicon nitride film of the kind can be produced by use of the so-called two-frequency type plasma CVD apparatus. Now, hereunder, the description will be made of the results of experiments carried out by the inventors hereof with respect to the formation of the silicon nitride film.

The two-frequency type plasma CVD apparatus used here is capable of supplying a high frequency (HF) of 13.56 MHz to the upper electrode, and a low frequency (LF) of 400 kHz to the lower electrode. By the studies made by the inventors hereof, the larger the ratio between the high frequency and low frequency, the greater becomes the compression stress of the silicon nitride film to be produced. Also, a tendency is confirmed that the higher the filming pressure, the smaller becomes the compression stress of the silicon nitride film.

When the structure is produced in accordance with the procedures shown in FIGS. 2A to 3C, the inner stress of an obtained silicon nitride film is a compression stress of $1.64\times10^8$ at the low frequency of 480 W, high frequency of 320 W, under the filming pressure of approximately 333 Pa at a filing temperature of 400° C., and with the supply of material gas of $SiH_4$ of 290 sccm, $NH_3$ of 1,900 sccm, and $N_2$ of 1,000 sccm. At the time of etching the supply port 120, there is no breakage or peeling off of the membrane portion, and it is recognized that this film can be used as membrane in good condition.

Also, the low frequency is set at 480 W, high frequency at 320 W, under the filming pressure of approximately 372 Pa at a filing temperature of 440° C., and with the supply of material gas of $SiH_4$ of 450 sccm, $NH_3$ of 1,900 sccm, and $N_2$ of 1,000 sccm. Then, under such condition, the inner stress of an obtain silicon nitride film is a compression stress of $1.28\times10^8$ Pa. At the time of etching the supply port 120, there is no breakage or peeling off of the membrane portion, and it is recognized that this film can be used as membrane in good condition.

Against this, the low frequency is set at 640 W, high frequency at 160 W, under the filming pressure of approximately 253 Pa at a filing temperature of 400° C., and with the supply of material gas of $SiH_4$ of 290 sccm, $NH_3$ of 1,900 sccm, and $N_2$ of 1,000 sccm. Then, at the time of etching the supply port 120, there is observed a leakage of etching solution from membrane under such condition, and this film cannot be used as membrane. The inner stress of the silicon nitride film thus obtained is a compression stress of $6.17\times10^8$ Pa.

As described above, with the adjustment of the low-frequency electric power and high-frequency electric power applied to the electrodes, it becomes possible to control the compression stress to be $3\times10^8$ Pa or less, and further, to be $5\times10^7$ Pa or more and $2\times10^8$ Pa or less. Particularly, when the low-frequency electric power is controlled to be within a range of 300 W to 600 W, and the high-frequency electric power to be within a range of 500 W to 200 W, it becomes possible to adjust the compression stress to be $1\times10^8$ Pa or more and $2\times10^8$ Pa or less.

When the structure described above is formed as the base plate, which is used for an ink jet recording head, the pattering process (only limited to the one that needs photo-mask) related only to the formation of the supply port 120 is, as shown in FIG. 2B, the process in which the oxide film 108 is partly removed; as shown in FIG. 2C, the process in which the poly-silicon layer 121 is selectively provided; and as shown in FIG. 3C, the process in which the silicon base plate 100 is etched to form the supply port 120. Here, two processes are curtailed from the conventional processes shown in FIGS. 10A to 11C. Further, if the formation of the poly-silicon layer 121, which becomes a sacrificing layer, is made simultaneously in the formation process of the gate electrodes of the MOS transistor, one more process can be curtailed.

Therefore, in accordance with the method of the present embodiment, the numbers of photo-masks needed as a whole can be reduced by two to three as compared with the conventional method.

Figure 4:
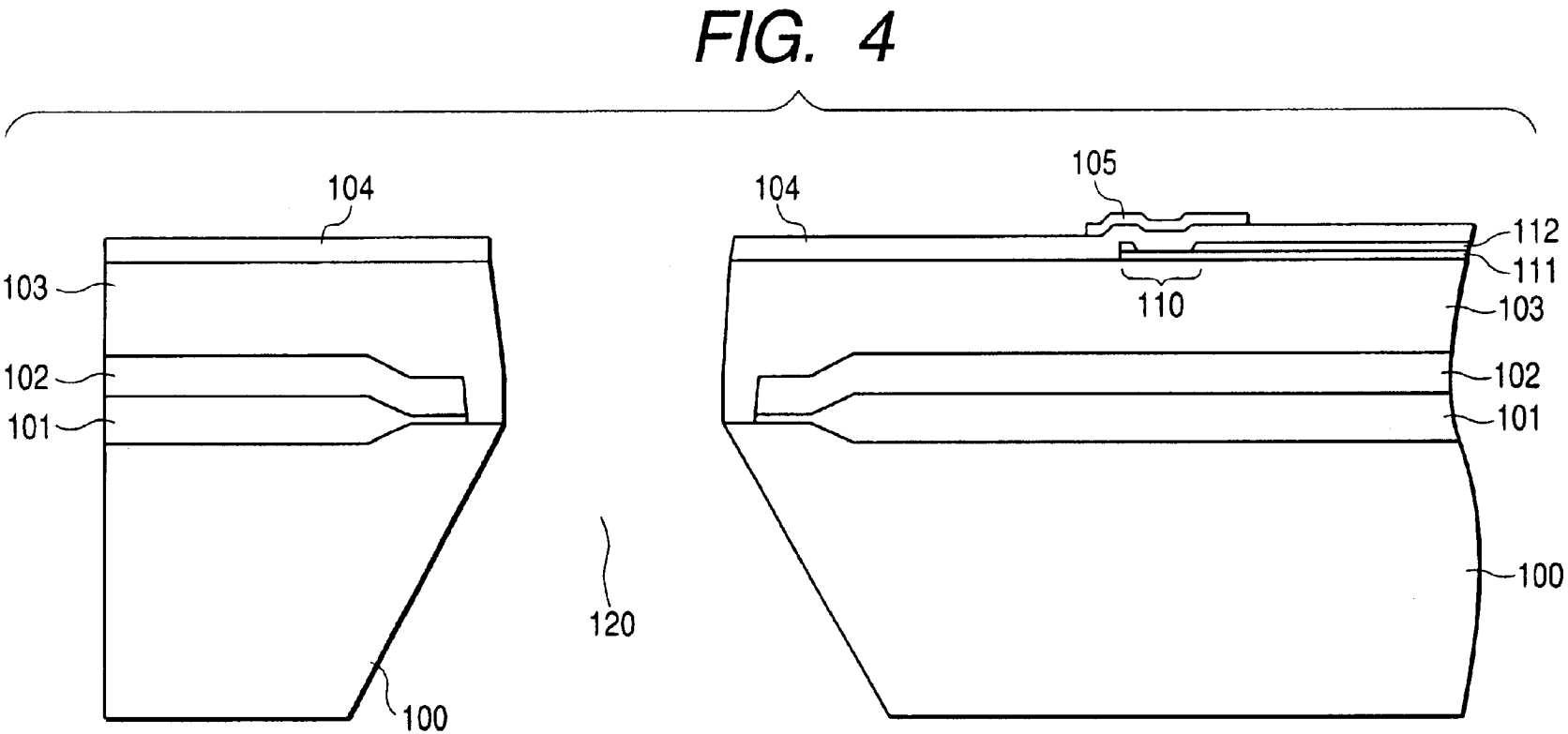
FIG. 4 is a cross-sectional view that schematically shows a structure used as a base plate for an ink jet recording head, which is the structure in accordance with another embodiment of the present invention.

FIG. 4 is a cross-sectional view that schematically shows a structure in accordance with another embodiment of the present invention. The structure shown in FIG. 4 is formed as the base plate used for an ink jet recording head. This is the same as the one shown in FIG. 1, but on the edge portions of the supply port 120, the silicon nitride film 104, which is formed by the plasma CVD method, is not directly in contact with the silicon base plate. The difference lies in that the silicon nitride film 103 is directly in contact with the silicon base plate 100 without intervention of oxide film instead. The filming condition is set so as to make the inner stress of the silicon nitride film 104 a compression stress of $3\times10^8$ Pa or less when produced.

Now, for the method of manufacture of this structure, the description will be made in conjunction with FIGS. 5A, 5B, and 5C, and FIGS. 6A and 6B. FIGS. 5A, 5B, and 5C, and FIGS. 6A and 6B represent only around the position where the supply port 120 is formed, but it is not intended to represent the ones that contain the formation area of the heat generating resistive member.

Figure 5A:
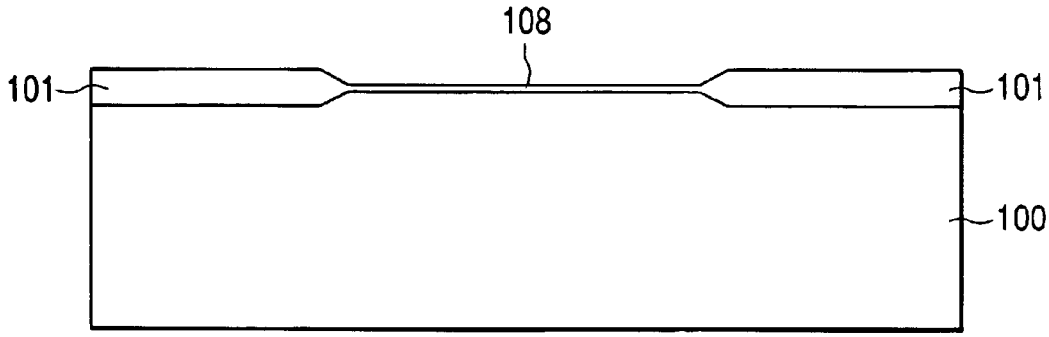
FIGS. 5A, 5B, and 5C are cross-sectional views that schematically illustrate the manufacturing process of the structure shown in FIG. 4.
Figure 5B:
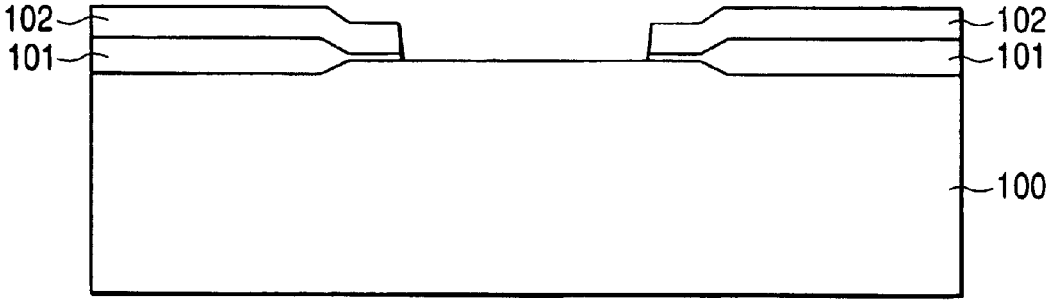
Figure 5C:
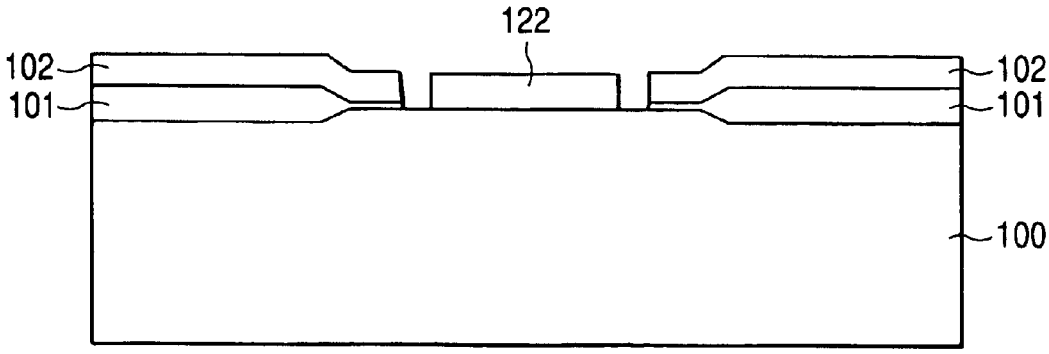

At first, as shown in FIG. 5A, a field oxide film 101 is formed selectively by thermal oxidation in a thickness of approximately 700 nm, for example, on one main surface of a silicon base plate 100. On the portion where no filed oxide film 101 is formed, a thin oxide film 108 is formed. It is preferable to arrange this oxide film 108 to function as a gate oxide film in the driving circuit and peripheral circuits, because then a process can be curtailed. After that, on the area of the driving circuit and peripheral circuits, the gate electrodes are formed, and subsequent to the impurity implantation into the source/drain regions, the BPSG layer 102 is formed by the non-pressure CVD method on the entire surface in a thickness of 700 nm, for example. Then, as shown in FIG. 5B, in the process of forming contact holes for the driving circuit and peripheral circuits, the BPSG layer 102 and the oxide film 108 are removed simultaneously by etching corresponding to the position where the supply port 120 is formed. Thus the silicon surface is exposed. Here, there is no need for the provision of mask dedicated for use of the exposure of the silicon surface on the supply port portion. Further, as shown in FIG. 5C, in the process of forming the source and drain electrodes for the driving and peripheral circuits, the aluminum (Al) film that contains copper (Cu) is selectively deposited on the silicon surface simultaneously corresponding to the exposed position on the silicon surface, and etched to form a sacrificing layer 122 formed by aluminum in a thickness of 400 to 800 nm, for example. If this aluminum layer that contains copper or silicon is used as an electrode contact layer for the driving circuit and peripheral circuits, the mask dedicated for use of the sacrificing layer on the supply port portion is not needed. At this juncture, it is arranged to surround the sacrificing layer 122 completely by the silicon surface where no oxide film 108 is formed.

Figure 6A:
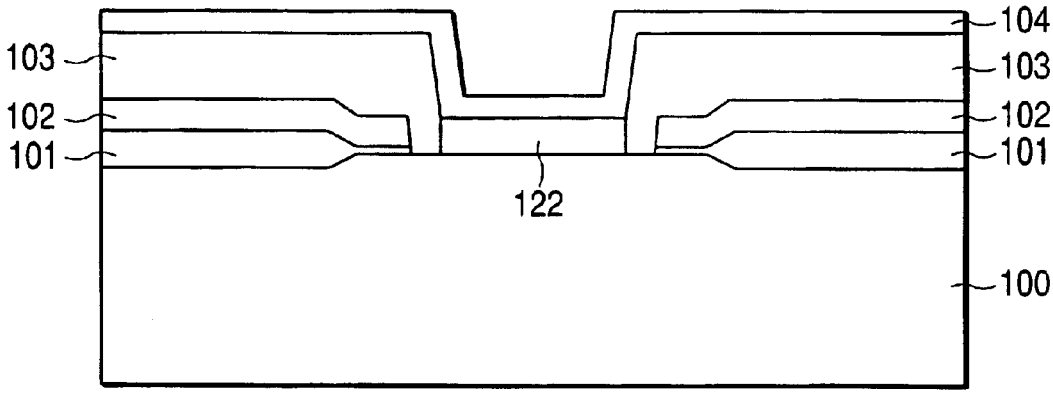
FIGS. 6A and 6B are cross-sectional views that schematically illustrate the manufacturing process of the structure shown in FIG. 4.

Subsequently, with the plasma CVD method, the silicon oxide film 103 is formed on the entire surface in a thickness of 1.4 $\mu$m, for example. Then, in the process of forming through hole for use of interlayer wiring for the driving circuit and peripheral circuits, the silicon oxide film 103 is removed simultaneously corresponding to the position where the supply port 120 is formed so as to enable the surface of the sacrificing layer 122 to be exposed. Here, there is no need, either, for the provision of any mask dedicated for use of the supply port portion. After that, although not shown here, the heat generating resistive member is formed in the same manner as in the case of the conventional art. The formation of plug for wiring use and wiring layer may be carried out simultaneously at this time. Then, as shown in FIG. 6A, the silicon nitride film 104, which serves as the passivation layer, is formed by the plasma CVD method on the entire surface in a thickness of 300 to 800 nm, for example, and further, the tantalum film (not shown), which becomes the cavitation proof layer, is formed selectively.

Figure 6B:
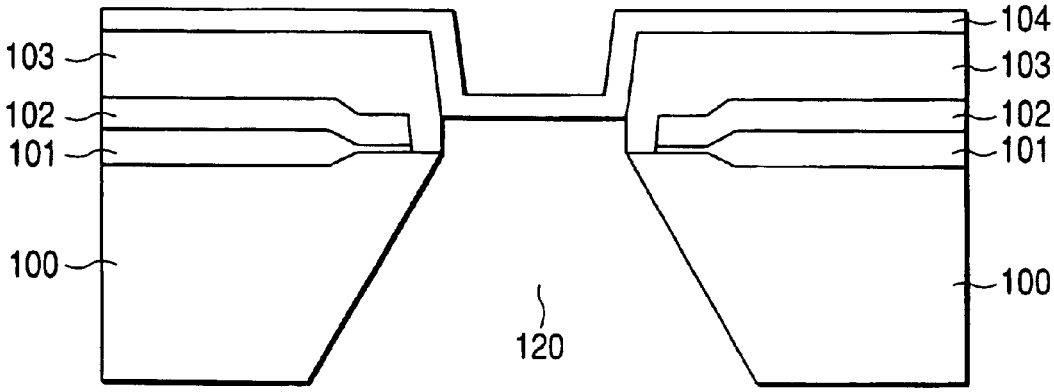

Then, from the lower side of the silicon base plate 100 shown in FIG. 6B, the silicon base plate 100 and the sacrificing layer 122 on the opposition where the supply port is formed are removed by dry etching to form the supply port 120 as shown in FIG. 6B. At this juncture, on the bottom portion of the supply port 120, the silicon nitride film 104 is exposed as the so-called membrane.

Lastly, by dry etching using fluorine gas or oxygen gas, the silicon nitride film 104 positioned on the bottom face of the supply port 120 is removed. In this way, the base plate for use of a recording head, which is provided with the supply port 120 for supplying ink or the like as a through hole, is completed. Thereafter, with the known method, the resin covering layer 130 and the discharge port 140 are formed to complete an ink jet recording head provided with the aforesaid structure as the base plate for use of a recording head.

When the structure described above is formed as the base plate used for an ink jet recording head, the patterning required for forming the supply port is carried out respectively in the same processes as the processes in which to form the contact hole, to form electrodes, and to form the through hole, which are needed for the formation of driving circuit and peripheral circuits. Therefore, the patterning related only to the formation of the supply port 120 (limited to the one that requires photo-mask) is only the process in which the silicon base plate 100 is etched to form the supply port 120. Thus, as shown in FIGS. 10A, 10B, 10C, and 10D, and FIGS. 11A, 11B, and 11C, four processes are curtailed from the conventional process. Therefore, in accordance with the method embodying the present invention, it becomes possible to reduce the required number of photo-masks by four in total as compared with the conventional art.

Now, in accordance with each of the embodiments described above, when the transistor and other elements, which constitute the driving circuit and peripheral circuits, and the heat generating resistive member are integrated monolithically, several processes and the process required for forming the supply port are provided for common use, hence making it possible to simplify the manufacturing processes significantly.

Figure 7:
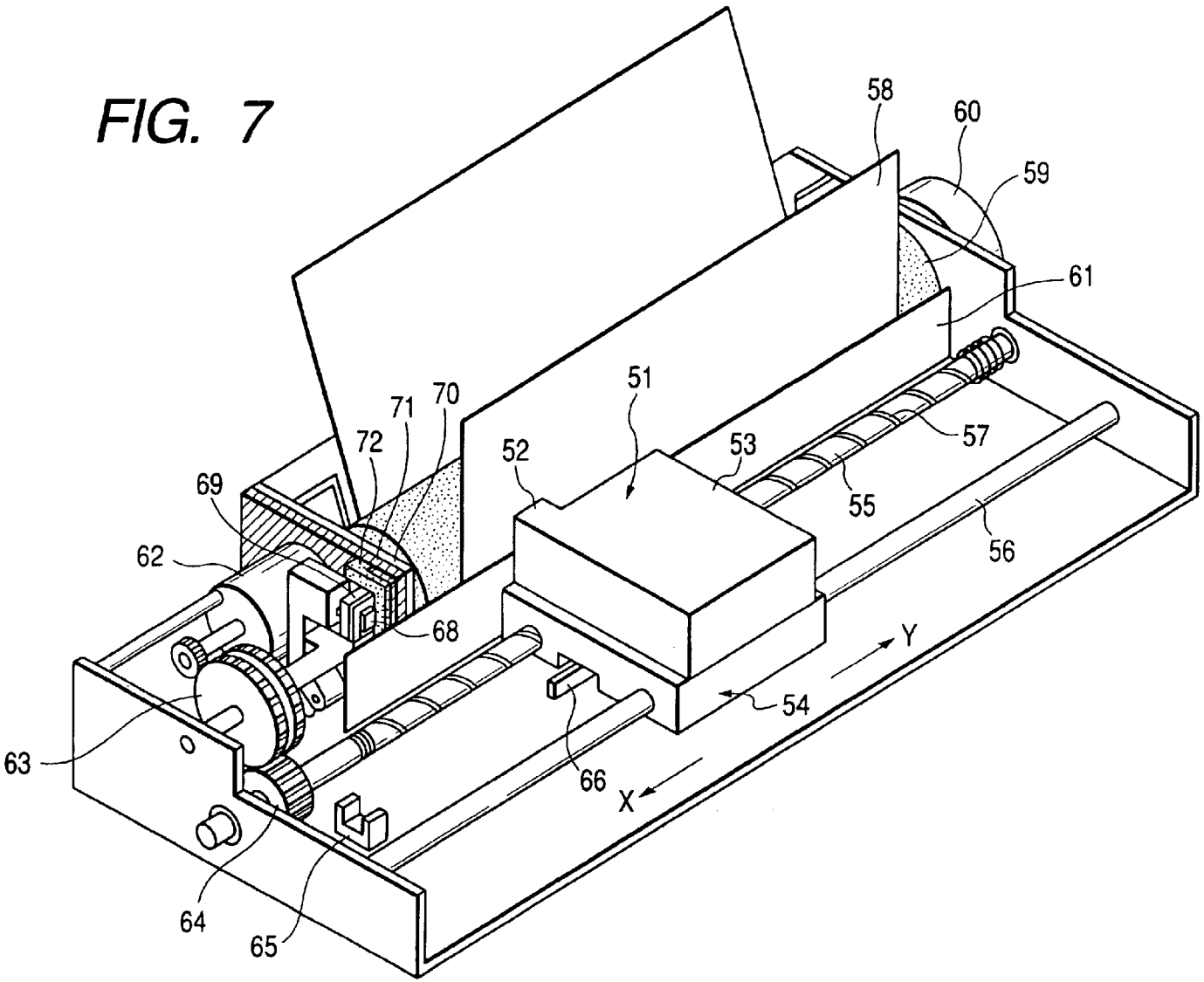
FIG. 7 is a perspective view that shows an ink jet recording apparatus.
Figure 8:
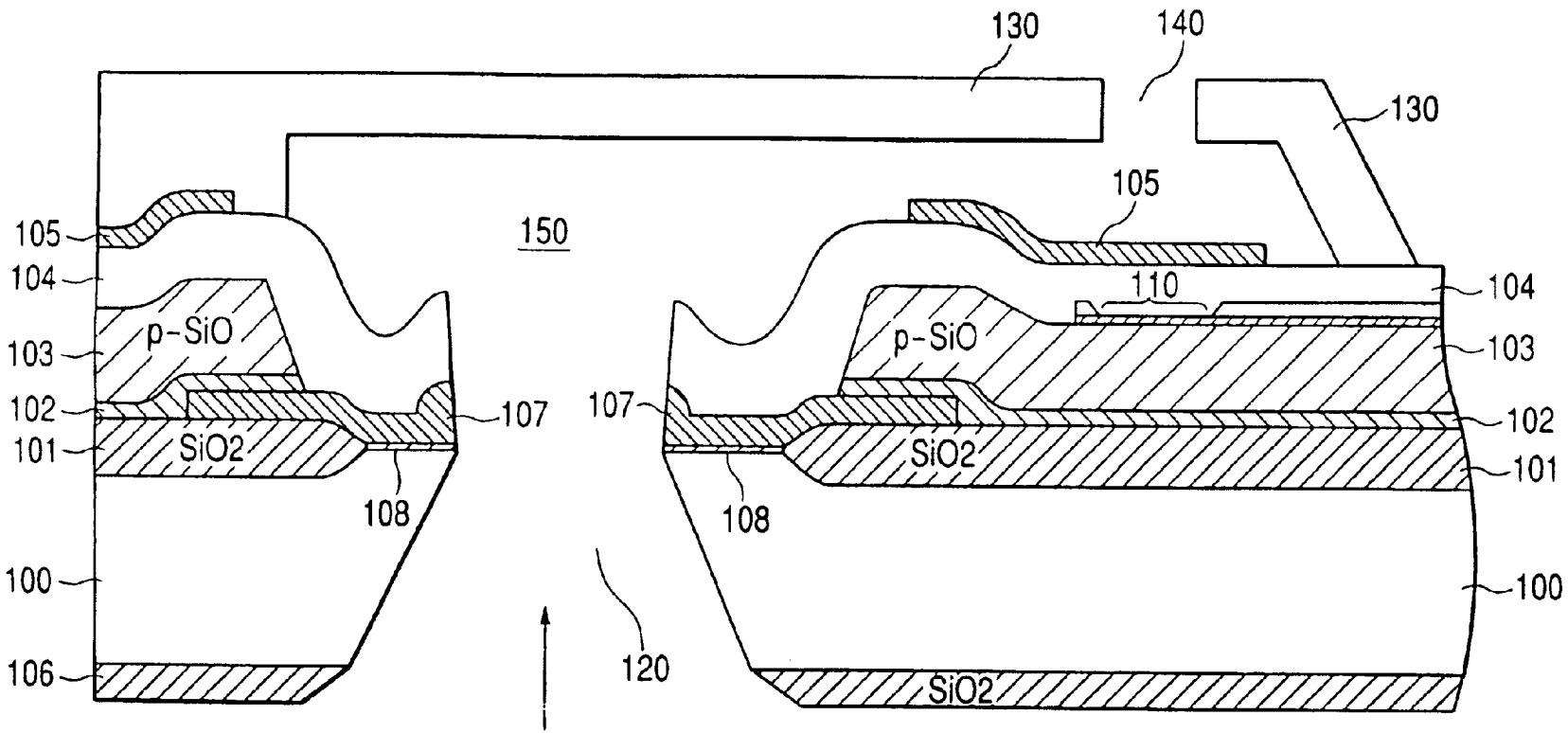
FIG. 8 is a cross-sectional view that schematically shows the structure of the conventional ink jet recording head.
Figure 9A:
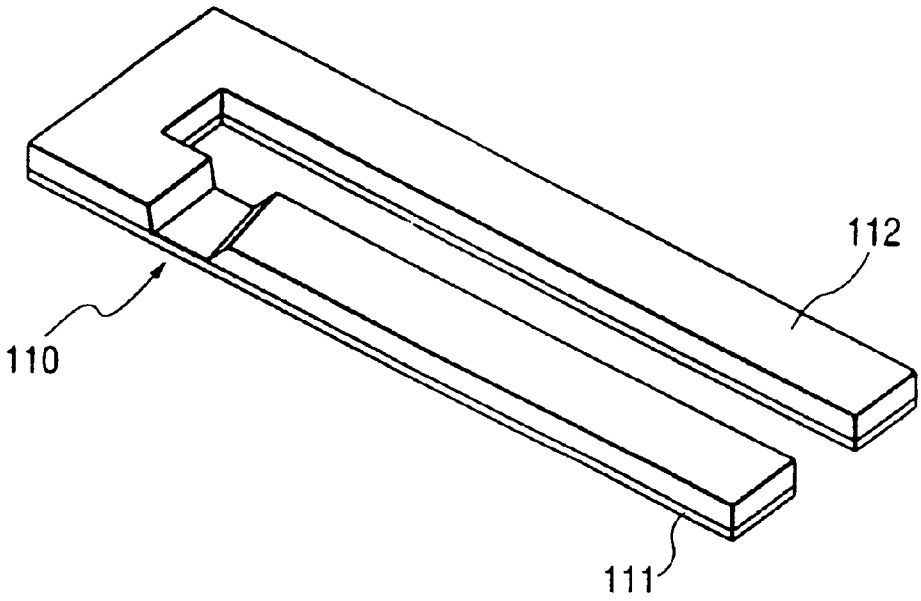
FIG. 9A PRIOR ART
FIG. 9A is a perspective view that shows a heat generating resistive member.
Figure 9B:
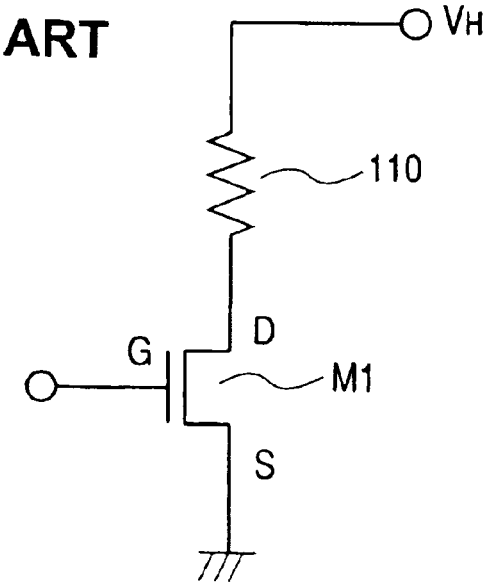
FIG. 9B PRIOR ART
FIG. 9B is a circuit diagram that shows a circuit that includes the heat generating resistive member, and the switching element (MOS field effect transistor) that drives it.
Figure 10A:
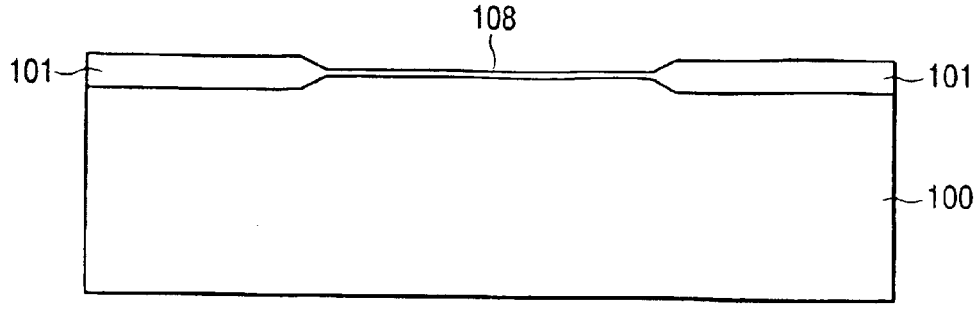
FIG. 10A PRIOR ART
FIGS. 10A, 10B, 10C, and 10D are cross-sectional views that illustrate the manufacturing process of the ink jet recording head shown in FIG. 8.
Figure 10B:
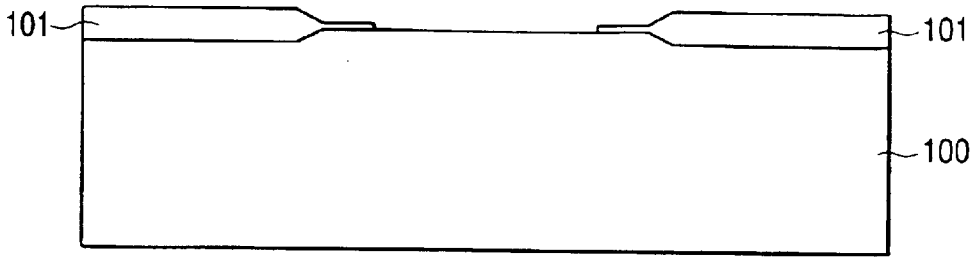
FIG. 10B PRIOR ART
Figure 10C:
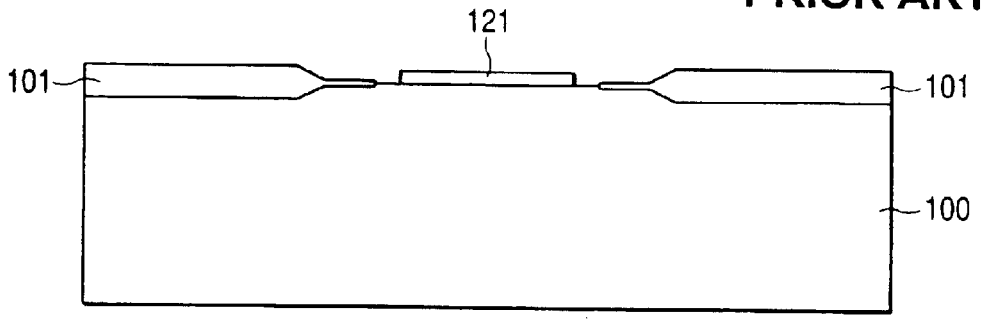
FIG. 10C PRIOR ART
Figure 10D:
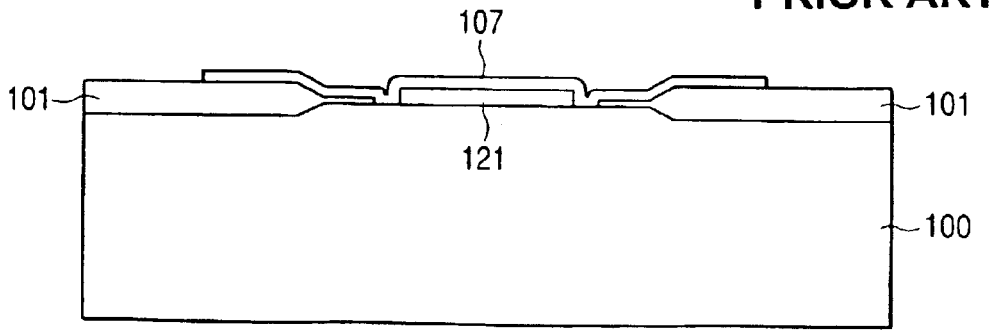
FIG. 10D PRIOR ART
Figure 11A:
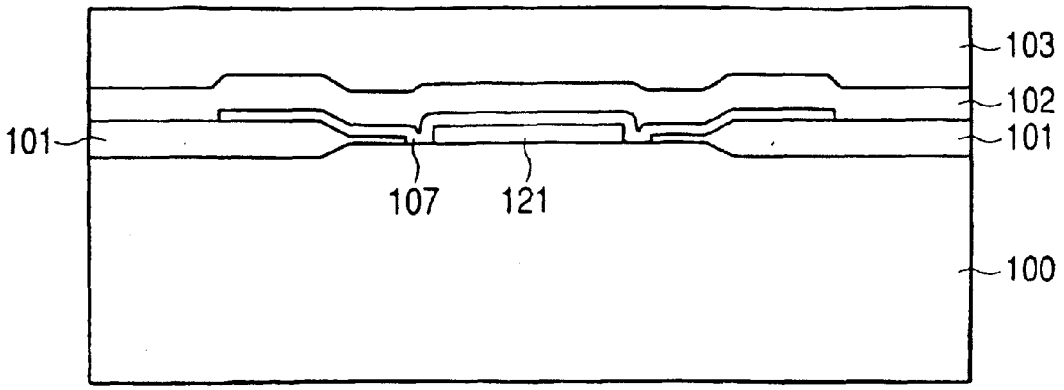
FIG. 11A PRIOR ART
FIGS. 11A, 11B, and 11C are cross-sectional views that illustrate the manufacturing process of the ink jet recording head shown in FIG. 8.
Figure 11B:
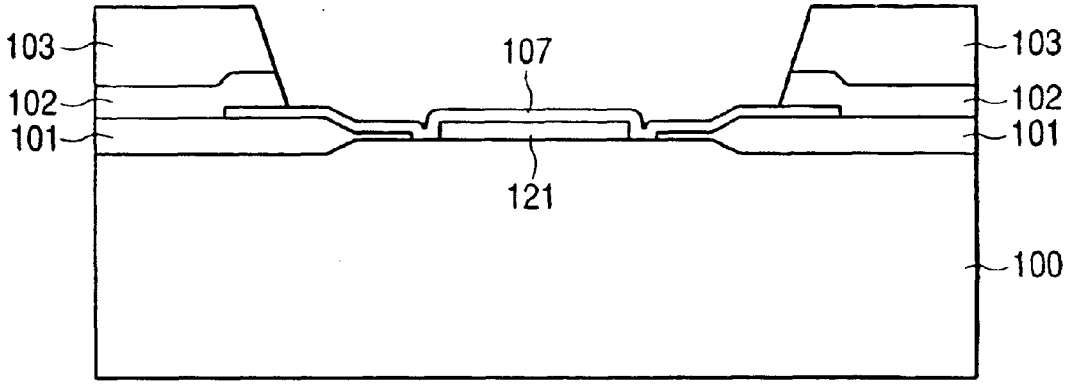
FIG. 11B PRIOR ART
Figure 11C:
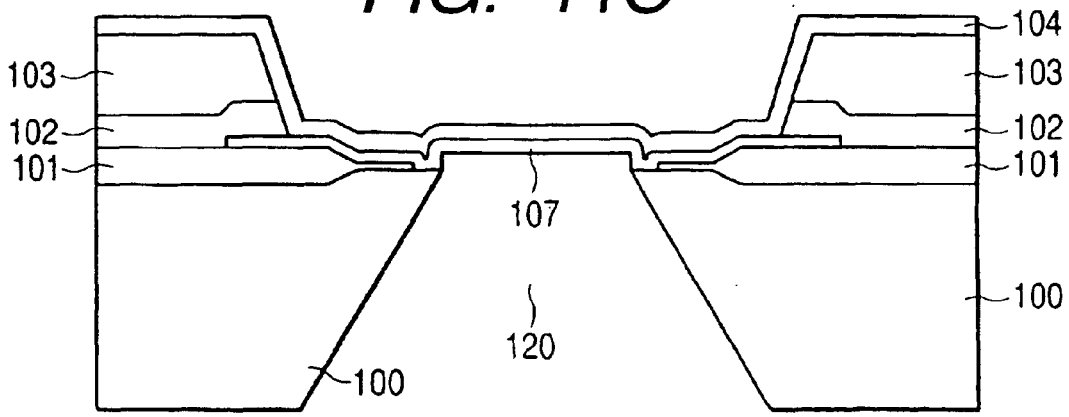
FIG. 11C PRIOR ART

Next, the description will be made of a liquid discharge apparatus of the present invention, that is, an ink jet recording apparatus provided with an ink jet recording head described above. FIG. 7 is a perspective view that schematically shows the structure of an ink jet recording apparatus of the kind. Here, a head cartridge 51, which is structured integrally with an ink jet recording head 52 and an ink tank 53 serving as a container for ink, is used.

The head cartridge 51 is exchangeably (detachably) mounted on a carriage 54. The carriage 54 travels forward and backward by the rotation of a carriage driving-shaft (lead screw) 55 along the carriage driving shaft 55 and a guide shaft 56 in the directions X and Y in FIG. 7 (main scanning direction). In other words, a spiral groove 57 is formed for the carriage driving-shaft 55, and a pin (not shown) is provided for the carriage 54, which engages with the spiral groove 57. Then, the structure is arranged to enable the carriage 54 to travel horizontally along the spiral groove 57 by the rotation of the carriage driving-shaft 55. Also, the head cartridge 51 is fixed to the designated position on the carriage 54 by positioning means, while electrically connected through contacts with the flexible cable that connects the carriage 54 and the control circuit, which is arranged on the main body side of the recording apparatus.

In FIG. 7, the conveying roller 59, which holds and feeds (conveys) a supplied recording material 58, is axially and rotatively supported in parallel to the carriage driving-shaft 55 on the position that faces the traveling range of the carriage 54. The conveying roller 59 exemplified in FIG. 7 dually functions as a platen (platen roller). The conveying roller 59 is driven by a carrier motor 60 to rotate. Also, the recording material 58 is pressed over to the conveying roller (platen roller) 59 by a sheet pressure plate 61 in the traveling (main scanning) direction of carriage 54.

On the main body side of the recording apparatus, a driving motor 62 is installed, and the carriage driving-shaft (lead screw) 55 is driving to rotate through driving power transmission gears 63 and 64. Then, by the regular and reverse rotations of the driving motor 62, the driving direction of the carriage driving-shaft 55 is made regular or reverse. In this manner, the traveling direction of the carriage 54 (arrow marks X and Y) is made changeable.

On a designated position (the position on the left side in FIG. 7) within the traveling range of the carriage 54 but outside the recording area, the home position of the carriage 54 is arranged. In the vicinity of the home position, a photo-coupler 65 is arranged. When the carriage 54 arrives at the home position, the photo-coupler 65 detects the ingression of the lever 66, which is provided for the carriage 54, thus detecting the arrival of the carriage 54 at the home position. In other words, the photo-coupler 65 is used as detecting means (a sensor) that controls various operations of the recording apparatus, such as to change the rotational directions of the driving motor 62 to reverse the traveling direction of the carriage or to start the recovery operation for removing or preventing clogging of the discharge ports of the recording head 52, among some others when the recording head 52 arrives at the home position.

In the home position, there is provided a cap 68 that covers (airtightly closes) the discharge port surface of the recording head 52 of the head cartridge 51. The cap 68 is movably supported by a cap holder 69 in the directions to be closely in contact with or retract from the discharge port surface. Between the cap 68 and the recording area, a blade (a cleaning member) 70 is arranged to wipe off the discharge port surface and cleans it (to perform cleaning operation). The blade 70 is movably held by the blade holder 72, which is supported by the main body supporting plate 71 so that it can move between the forward position where it can wipe off the discharge port surface and the retracted position where it is not in contact with the discharge port surface.

In this respect, as cleaning means for the discharge port surface, it may be possible to use various modes of members that can remove foreign substance, beside the one in the mode of the blade 70. Also, operations such as capping of the discharge port surface and cleaning of the discharge port surface are executed by the carriage 54 that may stop at or move in the corresponding position at a designated timing by the function of the spiral groove 57 of the carriage driving-shaft 55 when the carriage 54 comes into the home position side.

For the embodiments of the present invention, the description has been made by exemplifying the case where the base plate for use of an ink jet recording head is formed, but it is to be understood that the present invention is not necessarily limited thereto. The invention is generally applicable when a through hole is provided for the formation of a structure, such as a silicon base plate. For example, the invention is also applicable to the manufacture of the so-called micro-machines.

What is claimed is:

1. A liquid discharge head comprising:

a semiconductor base plate, a silicon oxide film and a silicon nitride film formed on a first main surface of said semiconductor base plate, and a heat generating resistive member formed on said silicon oxide film, said silicon nitride film being formed on said heat generating resistive member as a passivation layer, and said semiconductor base plate being provided with a supply port penetrating said semiconductor base plate and said silicon nitride film for supplying liquid; and a discharge port arranged to face said heat generating resistive member, wherein said silicon nitride film is formed on said silicon oxide film, either said silicon nitride film or said silicon oxide film contacts said semiconductor base plate at a circumferential portion of said supply port on said first main surface of said semiconductor base plate, and the inner stress of said silicon nitride film is a compressive stress of $3\times10^8$ Pa or less.

2. A liquid discharge head according to claim 1, wherein the inner stress is a compressive stress of $5\times10^7$ Pa or more and $2\times10^8$ Pa or less.

3. A liquid discharge head according to claim 1, wherein said semiconductor base plate is a silicon base plate.

4. A liquid discharge head according to claim 3, wherein said first main surface is provided with a circuit element.

5. A liquid discharge apparatus comprising:

a liquid discharge head according to claim 1; and a container for containing the liquid to be supplied through said supply port.

6. A liquid discharge head according to claim 1, wherein said silicon oxide film is patterned so that said silicon oxide film is disposed on said first main surface of said semiconductor base plate except for said circumferential portion of said supply port, and said silicon nitride film is disposed in contact with said semiconductor base plate at said circumferential portion of said supply port on said first main surface of said semiconductor base plate.

* * * * *